US005370010A

United States Patent [19]

Herrlein

[11] Patent Number: 5,370,010

[45] Date of Patent: Dec. 6, 1994

[54] DRIVE GEAR FOR A SHUTTLELESS LOOM HAVING WEFT THREAD INSERTION DEVICE ALTERNATELY MOVABLE INTO AND OUT OF THE LOOM

[75] Inventor: Wilhelm Herrlein, Neuravensburg, Germany

[73] Assignee: Lindauer Dornier GmbH, Lindau, Germany

[21] Appl. No.: 46,420

[22] Filed: Apr. 13, 1993

[30] Foreign Application Priority Data

Apr. 15, 1992 [DE] Germany ..... 4212536

[51] Int. Cl.[5] ..... F16H 25/08; F16H 1/14

[52] U.S. Cl. ..... 74/53; 74/420; 74/665 GC; 74/52; 139/1 E

[58] Field of Search ..... 74/29, 53, 89.11, 89.12, 74/89.16, 89.17, 109, 665 G, 665 B, 665 GC, 420, 423, 52; 139/1 E

[56] References Cited

U.S. PATENT DOCUMENTS 998,808 7/1911 Steere ..... 139/1 E
1,619,389 3/1927 Winters ..... 74/109
2,084,645 6/1937 Kliewer ..... 74/29 X
3,383,929 5/1968 Grutter ..... 74/53
4,878,392 11/1989 Jaeger et al. .

FOREIGN PATENT DOCUMENTS 1228374 8/1960 France ..... 74/89.17

*Primary Examiner*—David W. Laub
*Attorney, Agent, or Firm*—W. G. Fasse; W. F. Fasse

[57] ABSTRACT

A gear drive for shuttleless looms has an input transmission train and an outpost transmission train cooperating for converting the continuous rotational movement of the main loom drive shaft into an oscillating back and forth movement which in turn is converted into a horizontal back and forth movement of the respective gripper rod carrying a gripper head back and forth into the loom shed. The output transmission section or train has two auxiliary parallel output drive shafts, both of which are driven from a central output drive shaft. Two pinions at the free ends of the auxiliary parallel drive shaft mesh with the gripper rod, thereby distributing the drive forces over a larger surface area for reducing the wear and tear on the gripper rod and on the two parallel output drives.

9 Claims, 5 Drawing Sheets

DRIVE GEAR FOR A SHUTTLELESS LOOM HAVING WEFT THREAD INSERTION DEVICE ALTERNATELY MOVABLE INTO AND OUT OF THE LOOM

FIELD OF THE INVENTION

The invention relates to a gear drive for shuttleless looms. Such looms have a weft thread insertion device, for example in the form of tapes carrying gripper heads or gripper rods carrying gripper heads.

BACKGROUND INFORMATION

The insertion of the weft thread into the loom shed requires an accurate precise operation of the weft thread insertion device. U.S. Pat. No. 4,878,392 (Jaeger et al.), published on Nov. 7, 1989 discloses a gear drive for shuttleless looms of the types here involved. Such gear drives comprise components which convert the rotational continuous movement of the main loom drive shaft into a back and forth movement of the weft thread inserting device. These components produce two rotational movements that are alternatingly directed in opposite directions and these opposite rotational movements are in turn converted into the linear back and forth movement of the weft thread insertion devices.

The above mentioned gripper heads that are either carried by gripper rods or flexible tapes are so arranged that one gripper head carries the weft thread half way into the loom shed and the other gripper head carries the weft thread all the way out of the loom shed. The rods or tapes with the gripper heads enter and exit the loom shed from the opposite sides to carry the weft thread completely through the loom shed. Different conventional devices for the just described weft thread insertion are known in the art. Only the drives for these insertion devices are of interest to the present invention.

Flexible tapes are, for example, wound up on disks that are driven in one direction or in the opposite direction. Similarly, gear wheels may engage a toothed rack that forms the gripper head carrying rod. Gear wheels engaging perforations in the flexible tapes carrying the gripper heads are also known. The gear drives used for the just described purpose comprise conventionally a first gear section for converting the continuous unidirectional rotation of the main loom drive shaft into oppositely directed rotations, and a second gear section for transmitting the oppositely directed rotational movements to the respective weft thread insertion device. The first gear section comprises continuously rotating cams cooperating with cam followers which in turn drive a piston rod type connecting rod which drives a gear sector, whereby the gear sector performs an oscillating back and forth motion. The second gear section in turn transmits the back and forth motion of the gear sector through gear components to the weft thread insertion devices, whereby any required r.p.m. translation will be performed. For example, the second gear section includes a drive wheel that meshes with a gear or rack section of a gripper rod or that meshes with perforations in a flexible tape carrying a gripper head. If required, angular gears are used to change the direction of power transmission. Thus, the oscillating motion of the gear sector is transformed into an alternating rotational movement of the gear wheel driving the insertion device. The stroke of the back and forth movement can normally be adjusted by adjusting the connection of the connecting rod to the gear sector. These adjustments make it possible to precisely determine the extent to which the gripper heads move into and out of the loom shed. These adjustments thus make it possible to vary the motion of the gripper heads in accordance with the required weaving width.

Conventionally, a single output drive shaft, and thus a single output drive wheel, transmits the alternating back and forth motion to the gripper rod or tape. Due to the continuous direction reversal the components involved in the direction reversal and drive are subject to substantial wear and tear. Such a single wheel drive also exposes the gripper rod or gripper tape to excessive wear and tear. Thus, there is room for improvement in the just described conventional drives.

OBJECTS OF THE INVENTION

In view of the foregoing it is the aim of the invention to achieve the following objects singly or in combination:

- to avoid or at least substantially reduce the above mentioned wear and tear and thus to increase the useful life of the drive gears and of the gripper rod or tape;
- to divide the drive forces that are involved onto two separate output gear drive wheels so that each is exposed only to half of the force involved, whereby both drive gear wheels mesh with the gripper rod or tape and accordingly each applies only half of the force involved to different points of the rod or tape;
- to generally reduce substantially the wear and tear of the driving gear sections as well as of the driven element, such as the tape or gripper rod; and
- to provide the possibility of selectively using one or two drive gear wheels for the gripper rod or tapes, whereby in an emergency, operation of the loom can continue even with one drive wheel if the other should be damaged until maintenance or repair work becomes convenient.

SUMMARY OF THE INVENTION

The drive gear according to the invention combines the following features for operating a weft thread insertion device in a shuttleless loom. An input drive section and an output drive section are mounted in a housing or respective housing sections. The input drive section comprises a main input drive shaft and an input transmission train interposed between the main input drive shaft and the output drive section for converting a rotational movement of the main drive shaft which rotates in the same direction at all times into a rotational back and forth movement. The output drive section comprises an output drive shaft and output drive transmission elements operatively connecting the weft thread insertion device to the output drive shaft. The input transmission train further comprises a first gear or gears for applying the rotational back and forth movement to the output drive shaft. The output drive transmission elements comprise two freely rotatable auxiliary output shafts which are rotatably mounted in the housing and second gear elements rigidly mounted on the output drive shaft for driving the auxiliary parallel output shafts.

The output drive train elements further include third gears rigidly mounted on the freely rotatable auxiliary parallel output shafts for meshing with the second gear elements to drive the auxiliary parallel output shafts.

The second transmission elements or train further include fourth gears rigidly mounted on the freely rotatable parallel output shafts for moving the weft thread insertion device linearly back and forth in response to a back and forth rotation of the auxiliary shafts. The parallel shafts form a forked output.

Where it is necessary, for example, for space reasons, to detour the input drive transmission train the first gear elements will preferably use two meshing bevel gears to provide a 90° detour. Where such detour is not necessary, the present invention provides for a direct meshing between a spur gear wheel on the output drive shaft with the back and forth rotating elements such as a gear sector in the input drive train. Instead of the spur gear on the output drive shaft, the latter may carry a pinion that meshes with an internal spur gear of the back and forth rotating or oscillating gear sector of the input gear train. The spur wheel has external or internal gears.

The foregoing features achieve the objectives of the invention, especially a substantial reduction in the wear and tear of the driving and driven cooperating components of the gear drive.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
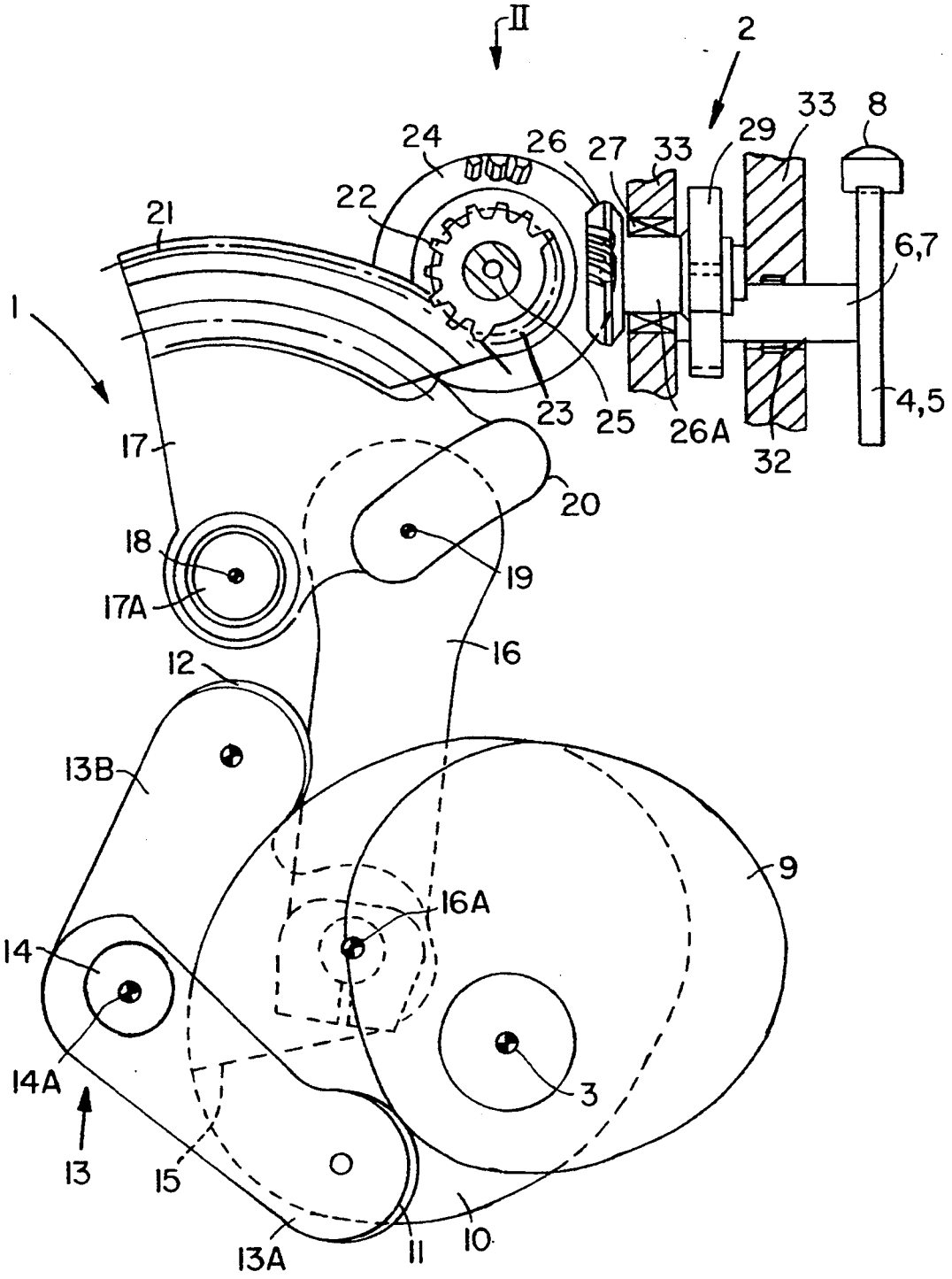
FIG. 1 shows a side view, partially in section, of a first embodiment of a gear drive according to the invention with a pair of bevel gears at the transition formed between the input drive train and the output drive train or section.

Referring to FIG. 1, the gear drive comprises an input transmission train 1 and an output transmission train 2. These transmission trains may also be referred to as gear sections. The components of these sections or transmission trains convert the continuous rotational movement of the main loom drive shaft 3 into an alternating clockwise and counterclockwise rotation of drive pinions 4 and 5 rigidly secured to two parallel auxiliary output drive shafts 6 and 7 which form a forked output and thus a redundant drive according to the invention for a weft thread insertion device 8, such as a gripper rod which has rack type gears meshing with the drive pinions 4 and 5.

The input transmission train shown in the lower portion of FIG. 1 comprises cam disks 9 and 10 rigidly secured to and driven by the main drive shaft 3. Cam follower rollers 11 and 12 are mounted to the free ends of bellcrank lever arms 13A and 13B respectively forming a bellcrank lever 13 journalled to an axle or shaft 14 operatively mounted in the housing 33. Thus, the bellcrank lever 13 is able to oscillate back and forth, or rather clockwise and counterclockwise about the axis 14A of the shaft or axle 14. A lever arm 15 rigidly connected to the bellcrank 13 and oscillating therewith transmits the oscillating movement through a connecting rod 16 to a gear sector 17 journalled on an axle or shaft 17A for oscillation about an axis 18.

The lower end of the connecting rod 16 is pivoted at 16A to a free end of the lever arm 15. The upper end of the connecting rod 16 is pivoted at 19 to the gear sector 17. The pivot joint 19 is adjustable relative to the gear sector 17 through a curved member 20 which may, for example, include an elongated arcuate guide hole. Thus, the adjustment of the pivot joint 19 in its position relative to the gear sector 17 permits adjusting the stroke of the gear segment 17 and thus an adjustment of the stroke of the weft thread insertion device 8. The gear sector 17 comprises a gear 21 having the contour of a circle sector. A spur gear or pinion 22 meshes with the gear 21.

Figure 2:
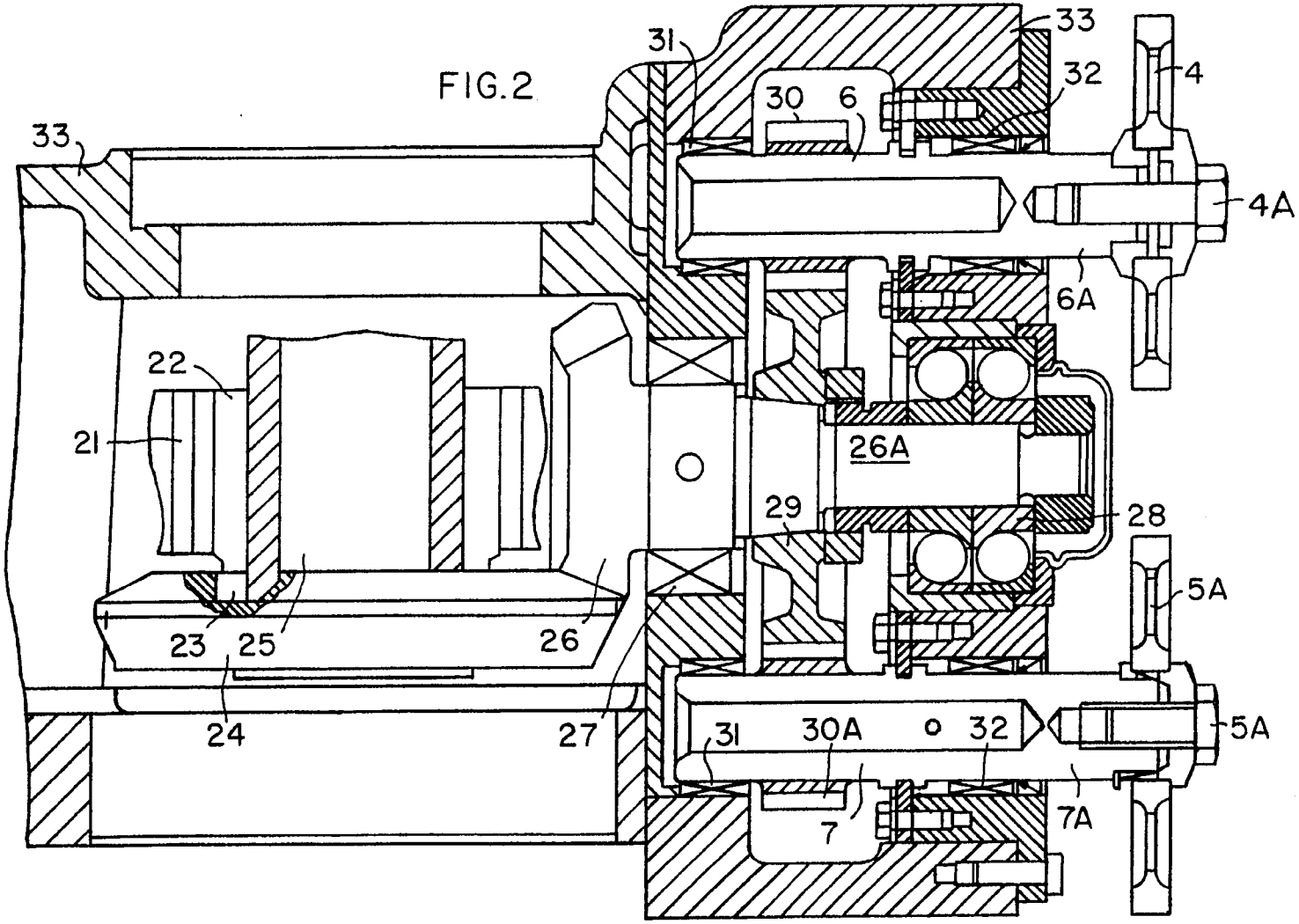
FIG. 2 is a view, partially in section in the direction of the arrow II in FIG. 1, illustrating the forked output drive train with two parallel auxiliary output shafts driven by a spur gear on the output shaft meshing with pinions on the auxiliary output shafts.

Referring to FIG. 2, the pinion or spur gear 22 is mounted for rotation around a shaft or axle 25 of a bevel gear 24. The pinion 22 has a gear portion engageable for meshing with an internal spur gear 23 of the bevel gear 24. The axle 25 of the bevel gear 24 is positioned in a vertical plane laterally displaced to and in parallel to the mounting shaft 17A of the gear sector 17, please see also FIG. 1. In FIG. 2, the gear 21 is partly visible below the shaft 25 and below the gear 22. As mentioned, the gear 22 meshing with the gear 21 forms a sleeve rotatable about the axle or shaft 25 which in turn is rotatably mounted in the housing of the output transmission section 2.

The bevel gear 24 meshes with a further bevel gear 26 rigidly secured to an output shaft 26A mounted for rotation in the housing 33. The rotational axis of the output shaft 26A and thus of the bevel gear 26 extends at a right angle to the rotational axis of the shaft or axle 25. The output shaft 26A carries a spur gear 29 rigidly secured to the output shaft 26A for rotation therewith. The transmission input train and the components of the transmission output train so far described are substantially the same as described in the above mentioned U.S. Pat. No. 4,878,392 (Jaeger et al.).

FIG. 2, however, further shows that according to the invention the output drive train downstream of the spur gear 29 comprises two auxiliary drive shafts 6 and 7 having secured thereto the above mentioned pinions 4 and 5 respectively for driving the gripper rod 8. The spur gear 29 meshes with two pinions 30 and 30A. The pinion 30 is rigidly secured to the auxiliary output shaft 6 which is mounted by bearings 31 and 32 in the housing 33 for rotation. The output shaft 26A with its spur gear 29 is mounted for rotation in the housing 33 by bearings 27 and 28. Both auxiliary parallel output shafts 6 and 7 are mounted for rotation in the housing 33 by respective bearings 31 and 32. The spur gear 29 meshes continuously with the pinions 30 and 30A. Free ends 6A and 7A of the parallel auxiliary output shafts 6 and 7 respectively extend out of the housing 33 and carry the above mentioned pinions 4 and 5 for driving the gripper rod 8 as shown in FIG. 1. Screws 4A and 5A rigidly secure the pinions 4 and 5 to the respective ends 6A and 7A of the shafts 6 and 7 for rotation therewith.

Figure 3:
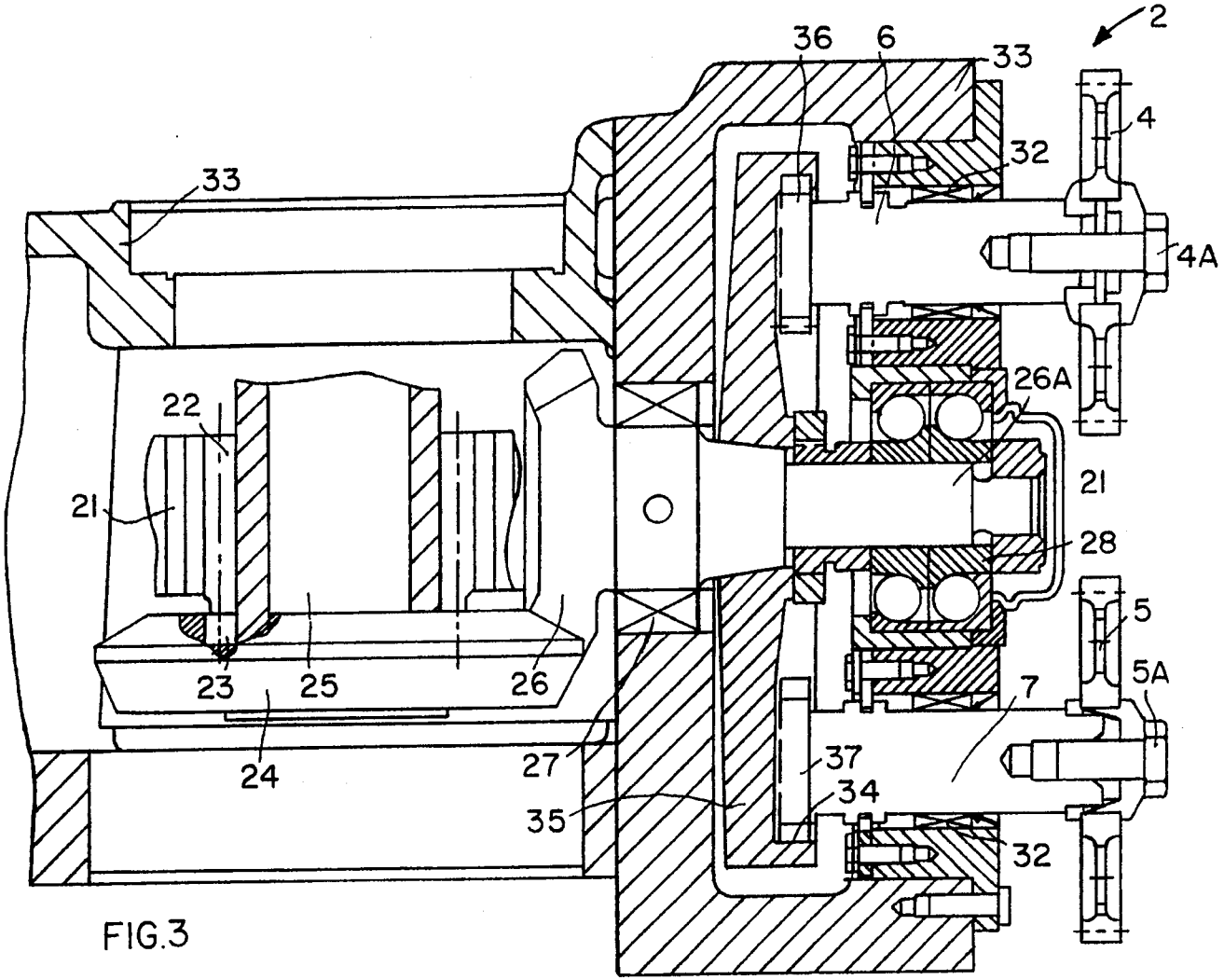
FIG. 3 is a view similar to that of FIG. 2, however illustrating a spur gear with internal gear teeth meshing with pinions on two parallel output shafts.

FIG. 3 shows a modification of the forked output transmission section shown in FIG. 2. Instead of the spur gear 29, FIG. 3 shows a sun wheel 35 with internal gearing 34 meshing with pinions 36 and 37 rigidly secured to the parallel output shafts 6 and 7 again rigidly carrying the pinions 4 and 5. The output shaft 26A is supported for rotation and driven just as in FIG. 2.

Figure 4:
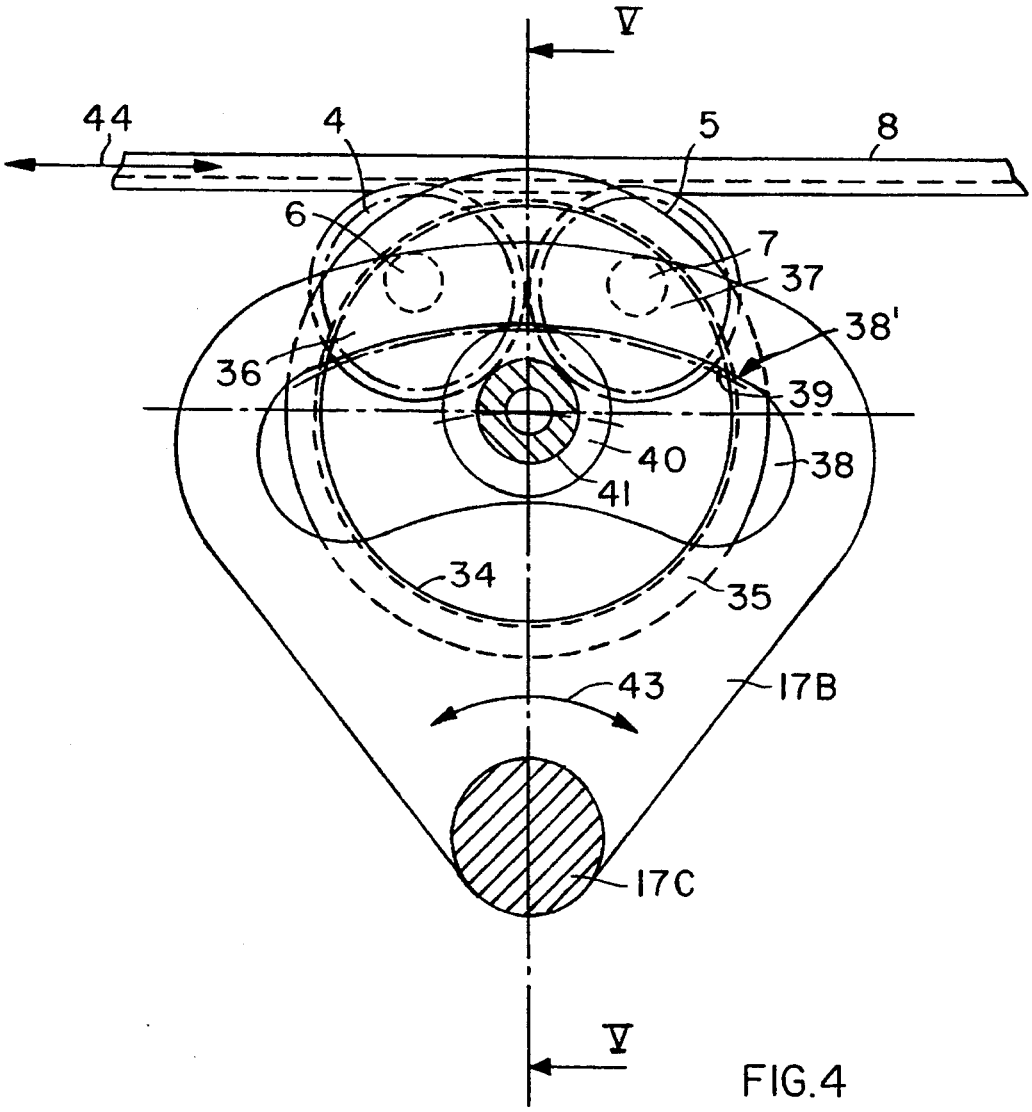
FIG. 4 is a sectional front view along section plane IV—IV in FIG. 5 with the housing sections removed and illustrating an embodiment of the invention in which a back and forth oscillating gear sector with internal gears meshes with a spur gear on the output drive shaft.
Figure 5:
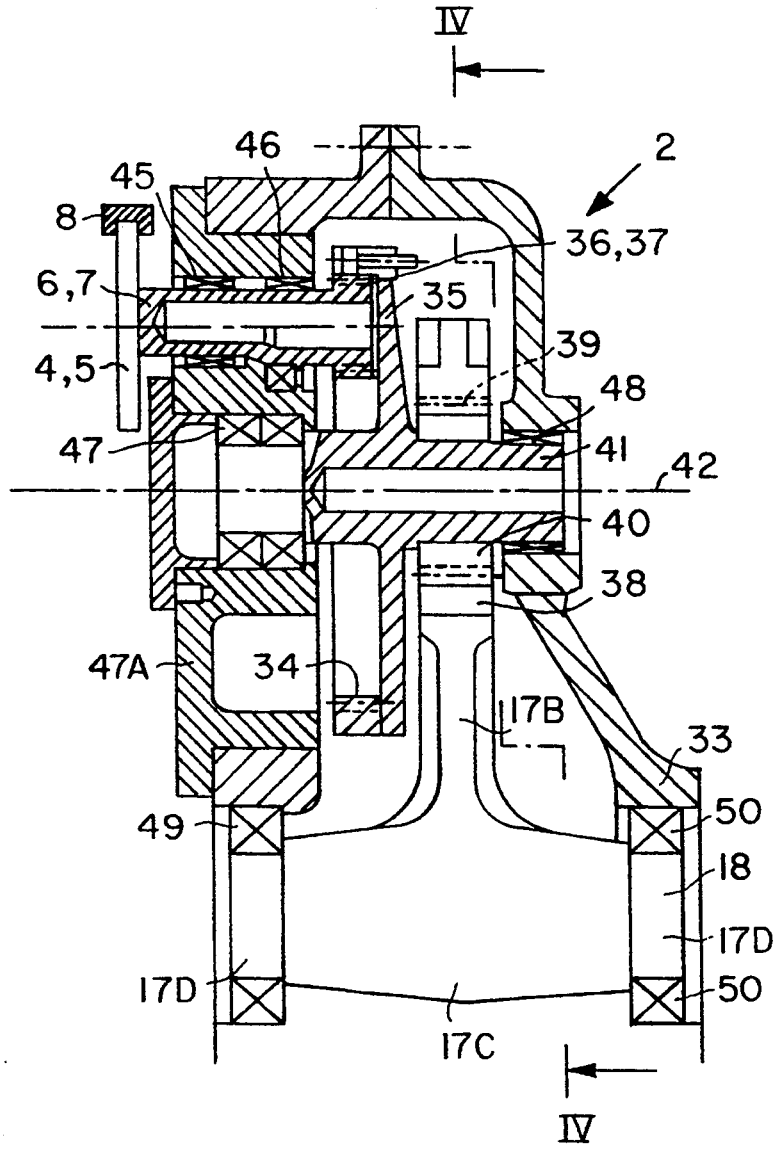
FIG. 5 is a sectional view along section plane V—V in FIG. 4 further illustrating the meshing of a gear with internal spur teeth and pinions of the forked output drive train.

FIGS. 4 and 5 show a further modification of the forked output transmission section according to the invention. A gear sector 17B is driven and mounted as shown in FIG. 1 for oscillating as indicated by double arrow 43 about tile journal shaft 18. The gear sector 17B has a recess 38 in which the upper circular arc 38' carries an inwardly facing spur gear 39. A pinion 40 rigidly secured to an output shaft 41 for rotation therewith meshes with the inner spur gear 39 of the gear sector 17B. The output shaft 41 carries again a sun wheel 35 rotating with the output shaft back and forth in response to the drive applied by the gear sector 17B. The sun wheel 35 transmits its drive through an internal gear 34 to two planetary gear pinions 36 and 37 driving the respective parallel output shafts 6 and 7 having rigidly secured thereto at the free ends thereof the drive pinions 4 and 5 for the gripper rod 8. The central axis or rather the rotational axis 42 of the output shaft 41 extends in this embodiment in parallel to the journal shaft 17C of the gear sector 17B which oscillates about the journal axis 18. For this purpose, the journal shaft 17C has journal stubs 17D mounted in bearings 49 and 50 in the housing 33. The output shaft 41 is rotatably supported by bearings 47 and 48 in the housing 33. The just described drive moves the gripper rod 8 back and forth as indicated by the double arrow 44 shown in FIG. 4. Thus, as the gear sector 17B oscillates clockwise and counterclockwise as shown by the arrow 43, the gripper rod 8 moves back and forth as shown by the arrow 44.

FIG. 5 shows the embodiment of FIG. 4 in a section along section plane V—V in FIG. 4. The pinion or spur gear 40 is positioned coaxially with the output sun wheel 35 on the output shaft 41.

Preferably, the sun wheel 35 and the output shaft 41 are constructed as an integral one-piece structure. As mentioned, the outer end of the shaft 41 is supported by bearings 47 in a cover 47A mounted in the housing 33, while the inner end of the shaft 41 is mounted in bearings 48 in the housing 33. Each of the parallel output shafts 6 and 7 are mounted in respective bearings 45 and 46 also mounted in the cover 47A. The pinions 36 and 37 meshing with the internal gear 34 may also be integral components of the respective auxiliary parallel output shafts 6 and 7. The pinions 4 and 5 are preferably secured to the free ends of the respective shafts 6 and 7 in the same manner as shown in FIG. 3.

Compared to the relevant prior art, the gear drive according to the invention has the advantage that the forces applied to the gripper head rod for causing the alternating back and forth movement is divided onto two auxiliary output shafts 6 and 7 with the respective gears 4 and 5 which in turn mesh with a rack type gear of the gripper rod 8, whereby the wear and tear is substantially reduced, not only for the drive pinions 4 and 5, but also for the gripper rod. Additionally, this forked output drive with the two parallel shafts 6 and 7 provides a redundancy that has the advantage that continuing the loom operation is possible if one of the parallel drives should fail, so that repairs can be done at more convenient times, for example, when the weaving run is completed.

Although the invention has been described with reference to specific example embodiments, it will be appreciated that it is intended to cover all modifications and equivalents within the scope of the appended claims.

What I claim is:

1. A drive gear for a shuttleless loom having a weft thread insertion device (8) for moving into and out of a loom shed, comprising an input drive section (1), an output drive section (2), and housing means for mounting said input and output drive sections, said input drive section comprising a main input drive shaft (3) and input transmission means (9 to 22) operatively interposed between said main input drive shaft (3) and said output drive section (2) for converting a rotational movement of said main drive shaft (3) into a rotational back and forth movement, said output drive section (2) comprising an output drive shaft (26A, 41), and output drive means (4, 5, 6, 7; 29, 30; 35, 36, 37) operatively connecting said weft thread insertion device (8) to said output drive shaft (26A, 41), said input drive section (1) further comprising first gear means (24, 26; 39, 40) for applying said rotational back and forth movement to said output drive shaft (26A, 41), said output drive means comprising two auxiliary parallel output shafts (6, 7) rotatably mounted in said housing means and forming a forked output drive, second gear means (29; 35) rigidly mounted on said output drive shaft (26A, 41) for driving said auxiliary parallel output shafts (6, 7), third gear means (30; 36, 37) rigidly mounted on said rotatable auxiliary parallel output shafts (6, 7) for meshing with said second gear means (29; 35) for driving said auxiliary parallel output shafts (6, 7), and fourth gear means (4, 5) rigidly mounted on said rotatable auxiliary parallel output shafts (6, 7) for moving said weft thread insertion device (8) linearly back and forth in response to a back and forth oscillation of said auxiliary shafts (6, 7).

2. The drive gear of claim 1, wherein said input transmission means comprise cam disks (9, 10) driven by said main input drive shaft (3), a gear sector (17, 21), fifth gear means (22) operatively meshing said first gear means (24, 26) to said gear sector (17, 21), and means (13, 15, 16) for transmitting drive power from said cam disks to said gear sector (17).

3. The drive gear of claim 1, wherein said first gear means comprise two bevel gears (24, 26) meshing with each other for driving said output drive shaft (26A), and fifth gear means (22) meshing with said input transmission means and with an inner gear (23) of one of said bevel gears (24).

4. The drive gear of claim 1, wherein said second gear means (29) comprises a spur gear (29) rigidly mounted on said output drive shaft (26A), and wherein said third gear means (30) are pinion gears on said rotatable auxiliary parallel output shafts (6, 7) meshing with said spur gear for linearly moving said weft thread insertion device (8).

5. The drive gear of claim 1, wherein said second gear means comprise a gear wheel (35) rigidly mounted on or forming an integral part of said output drive shaft (26A, 41), and wherein said third gear means comprise pinion gears (36, 37) rigidly mounted on said rotatable auxiliary parallel output shafts (6, 7) for meshing with and linearly moving said weft thread insertion device (8).

6. The drive gear of claim 5, wherein said gear wheel of said second gear means is a sun wheel having radially inwardly facing gear teeth (34), and wherein said pinion gears (36, 37) of said third gear means are rigidly mounted to a respective end of said parallel output shafts (6, 7) for meshing with said inwardly facing gear teeth (34).

7. The drive gear of claim 5, further comprising two bearing means (47, 48) for rotatably supporting said output drive shaft (41), said first gear means comprising a gear wheel (40) and said input transmission means comprising a gear sector (17B, 39), said gear wheel (40) directly meshing with said gear sector (17B, 39) for driving said output shaft (41).

8. The drive gear of claim 7, wherein said gear sector has a circular recess portion and radially inwardly facing gear teeth (39) in said circular recess portion, said gear wheel (40) meshing with said inwardly facing gear teeth (39).

9. A drive gear for operating a weft thread insertion device in a shuttleless loom, comprising a first input power transmission train for converting a continuous rotation of a main loom drive shaft into an oscillating drive motion, and a second output power transmission train for converting said oscillating drive motion into a linear back and forth motion, said second output power transmission train comprising an output drive member and two parallel auxiliary output drive members driven by said output drive member for imparting said linear back and forth motion to said weft thread insertion device.

* * * * *